US008152707B2

(12) United States Patent
Yamada

(10) Patent No.: US 8,152,707 B2
(45) Date of Patent: Apr. 10, 2012

(54) BIO CELL CLEANING CENTRIFUGE AND BIO CELL CLEANING ROTOR USED IN THE SAME

(75) Inventor: Kenji Yamada, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 924 days.

(21) Appl. No.: 12/142,422

(22) Filed: Jun. 19, 2008

(65) Prior Publication Data

US 2008/0318755 A1 Dec. 25, 2008

(30) Foreign Application Priority Data

Jun. 21, 2007 (JP) ..... P2007-163559

(51) Int. Cl.
*B04B 5/02* (2006.01)
*B04B 15/12* (2006.01)

(52) U.S. Cl. ..... 494/9; 494/7; 494/17; 494/20; 494/29; 494/37

(58) Field of Classification Search ..... 494/16, 494/17, 20, 21, 23, 27, 29, 30, 31, 33, 36, 494/60, 7–9, 37; 422/72
See application file for complete search history.

(56) References Cited

U.S. PATENT DOCUMENTS

| | | | | |
|---|---|---|---|---|
| 3,877,634 | A * | 4/1975 | Rohde et al. | 494/1 |
| 3,981,438 | A * | 9/1976 | Weyant | 494/20 |
| 4,449,964 | A * | 5/1984 | Westberg et al. | 494/16 |
| 5,045,047 | A * | 9/1991 | Hutchins et al. | 494/17 |
| 5,605,529 | A * | 2/1997 | Petithory | 494/16 |
| 6,846,281 | B2 * | 1/2005 | Murayama et al. | 494/17 |
| 6,857,997 | B2 * | 2/2005 | Yamada et al. | 494/17 |
| 2003/0216237 | A1 * | 11/2003 | Murayama et al. | 494/20 |
| 2008/0318755 | A1 * | 12/2008 | Yamada | 494/9 |

FOREIGN PATENT DOCUMENTS

| | | | |
|---|---|---|---|
| CN | 1459337 | A | 12/2003 |
| GB | 2388562 | A | 11/2003 |
| JP | 48-27267 | | 8/1973 |
| JP | 50-22693 | | 3/1975 |
| JP | 54-167860 | | 7/1981 |
| JP | 60-150857 | | 8/1985 |
| JP | 63-142261 | * | 6/1988 |
| JP | 2-81640 | | 6/1990 |
| JP | 2003-337088 | | 11/2003 |

OTHER PUBLICATIONS

Chinese Office Action, with English translation, issued in Chinese Patent Application No. 200810125263.X, mailed Jan. 10, 2011.

* cited by examiner

*Primary Examiner* — Charles E Cooley
(74) *Attorney, Agent, or Firm* — McDermott Will & Emery LLP

(57) ABSTRACT

According to an aspect of the present invention, there is provided a bio cell cleaning centrifuge including: a motor; a rotor rotated by the motor; holders that are equipped on the rotor and that hold test tubes to be pivotable toward a rotational radial direction of the rotor; a cleaning liquid distributor mounted on the rotor to supply a cleaning liquid to the test tubes; a locking mechanism that locks the holders so that the test tubes are in a vertical state with respect to the rotational radial direction; and a controller that controls the motor and the locking mechanism, wherein the holders are configured to hold the test tubes so that central axes thereof are inclined from a rotational axis direction toward a rotational tangent direction of the rotor.

7 Claims, 9 Drawing Sheets

BIO CELL CLEANING CENTRIFUGE AND BIO CELL CLEANING ROTOR USED IN THE SAME

CROSS-REFERENCE TO RELATED APPLICATIONS

This application is based upon and claims a priority from prior Japanese Patent Application No. 2007-163559 filed on Jun. 21, 2007, the entire contents of which are incorporated herein by reference.

BACKGROUND OF THE INVENTION

1. Field of the Invention

An aspect of the present invention relates to a bio cell cleaning centrifuge for cleaning bio cell such as red blood cell by centrifugal force, and particularly to a bio cell cleaning centrifuge which is suited to make a cleaning advantage large and make cleaning reliability high, and a bio cell cleaning rotor used in the same.

2. Description of the Related Art

Conventionally, a bio cell cleaning centrifuge (blood cell cleaning centrifuge) has been known, which is used, in an antiglobulin test in blood transfusion, a cross-matching test and irregular antibody screening, in order to remove unwanted antibody from a suspension by cleaning red blood cell with a cleaning liquid such as physiological saline.

The known bio cell cleaning centrifuge includes a motor having a drive shaft; a rotor which is coupled to the drive shaft of the motor and rotated by the motor; plural test tube holders which are attached onto the rotor in a circular array so as to be pivotally movable, and can pivotally move in a horizontal direction of the outside of the circular array upon application of centrifugal force generated by rotation of the rotor, and each of which is formed of a magnetic member; a cleaning liquid distributor which is attached to the rotor, rotates together with the rotor, and supplies cleaning liquid into plural test tubes respectively held by the plural test tube holders; and a magnetic element (locking mechanism) which attracts the test tube holder vertically or at a nearly vertical angle by magnetic attraction force generated by a magnetic coil.

For example, a cleaning liquid distributor in a cleaning centrifuge has been disclosed in JP-S50-022693-A. This distributor is characterized by including a container of which the inner surface is conical and nozzles arranged radially from a periphery of a bottom of the container, distributing equally the cleaning liquid injected from the center of the cleaning liquid distributor rotating together with the rotor upon application of the centrifugal force, and supplying the cleaning liquid from the nozzles into many test tubes held by the test tube holders.

Further, a technology of supplying cleaning liquid from a hole drilled in a cleaning liquid distributor that rotates together with a rotor into a test tube in a test tube holder supported so as to be pivotally movable by a rotor has been disclosed in JP-UM-H02-081640-A. Further, in JP-UM-H02-081640-A, it has been also disclosed that the rotor holds the test tube holder by a magnetic element Further, a technology of rotating a rotor at a low speed while holding a test tube holder on a rotor by a rim or a rotary member at a small angle from a vertical direction thereby to discharge a supernatant of cleaning liquid from a test tube has been disclosed in JP-S48-027267-B and JP-S60-150857-A. Further, a technology of holding a test tube holder on a rotor by a magnetic element at a smaller angle from a vertical direction and of rotating the rotor at a low speed thereby to discharge a supernatant of cleaning liquid from a test tube held by the test tube holder has been disclosed in JP-UM-S54-167860-A.

On the other hand, in the bio cell cleaning centrifuge, an automatic blood cell cleaning centrifuge has been known, which executes automatically in turn a cleaning liquid injection step, a centrifugal step, a supernatant discharging step, and an agitate step which are included in a cleaning process. For example, an automatic blood cell cleaning centrifuge has been sold as a product name "himac MC450" by Hitachi Koki Co., Ltd. FIG. 8 shows, in such the conventional automatic bio cell cleaning centrifuge, a time chart for executing a cleaning process performed for the purpose of blood transfusion test. This time chart relates to rotation of a rotor drive motor, an operation of a pump of a cleaning liquid distributor, and energization to a magnetic coil of a magnetic element for fixing a test tube holder. A cleaning process using the conventional automatic blood cell cleaning centrifuge is executed as follows.

(1) First, in the cleaning liquid injection step at time (1) shown in FIG. 8, a test tube in which bio cell such blood cell has put is set in a test tube holder on a rotor, a motor for driving the rotor is rotated in an accelerative way, its centrifugal force moves pivotally the lower part of the test tube in the test tube holder outward, and the rotor (motor) is rotated in a state where the test tube is inclined at a predetermined angle to the horizontal direction from the vertical direction. At this time, as shown in FIG. 8, at the time (1), by putting the pump operation into an ON-state (a state where electric power is supplied to a pump), cleaning liquid is injected into the test tube through a cleaning liquid distributor which rotates together with the rotation of the rotor. The blood cell is stirred by the vigor of the injected cleaning liquid and cleaned.

(2) Next, in the centrifugal step at time (2) shown in FIG. 8, the rotor (motor) is centrifuged, for example, at 3000 rpm for 45 seconds. Hereby, the blood cell is deposited at the bottom of the test tube and an undesired substance such as a blood serum remains in a supernatant state.

(3) Further, in the supernatant discharging step at time (3) shown in FIG. 8, by putting the power supply to the magnetic coil in an ON state and putting the operation of the magnetic element into an ON state, the test tube holder is attracted in a nearly vertically state and fixed by the attractive force produced in the magnetic element. When the rotor is rotated again at a low speed, for example, at 400 rpm under this state, the test tube is directed such that its upper end is opened at a small angle or directed in the vertical direction. Therefore, the supernatant rises on the wall surface of the test tube because of the application of centrifugal force and then is discharged out of the test tube. When the rotation of the rotor is immediately stopped, only the deposited blood cell remains in the test tube.

(4) Next, in the agitate step at time (4) shown in FIG. 8, by repeating rotation and stop of the rotor gradually by turns, or repeating forward rotation and reverse rotation of the rotor gradually by turns, agitation is given to the test tube in the test tube holder on the rotor, thereby to loosen the blood cell deposited and solidified at the bottom of the test tube.

Cleaning is executed by usually repeating this cleaning cycle including the above four steps three to four times.

In JP-2003-337088-A, a bio cell cleaning rotor has been disclosed, which includes a cleaning liquid distributor used in a bio cell cleaning centrifuge for executing the above cleaning process, and a rotor around which test tube holders for holding plural test tubes to which cleaning liquid are supplied from the cleaning liquid distributor are attached in a circular array. FIGS. 9, 10 and 11 show the structure of the bio cell cleaning rotor which has been disposed in JP-2003-337088-A and includes the cleaning liquid distributor and the rotor which are generally used.

As shown in FIG. 9, a bio cell cleaning rotor 25 includes a rotor 2; plural test tube holders 3 which are attached onto the rotor 2 in a circular array so as to be pivotally movable around a pivot axis 3*a*, and pivotally moves toward a horizontal direction outside the circular array upon application of centrifugal force generated by the rotation of the rotor 2; and a cleaning liquid distributor 5 which is attached to the rotor 2, rotates together with the rotor, and supplies cleaning liquid to plural test tubes 4 held respectively by the plural test tube holders 3. As shown in FIGS. 10 and 11, the test tube holder 3 is characterized by holding the test tube 4 in a vertical state so that a center axis 4*a* of the held test tube 4 coincides with a vertical line direction 4*y* along a rotation axis 8*a* of the rotor 2.

In case that the above-mentioned cleaning liquid injection step is executed using such the bio cell cleaning rotor 25, as shown in FIG. 12, the test tube holder 3, without moving pivotally in the rotational direction or in the tangent direction of the circular array, moves pivotally in a horizontal direction outside the circular array because of the application of the centrifugal force generated by rotation of the bio cell cleaning rotor 25 thereto, and cleaning liquid 5*a* is injected in the test tube 4 to clean the bio cell. Further, in the supernatant discharging step after the above cleaning liquid injection step, as shown in FIG. 13, the test tube holder 3 is fixed by the magnetic element in a vertical state or in a nearly vertical state, and the supernatant is discharged while the test tube 4 is being held in the vertical state by the test tube holder 3 so that the center axis 4*a* of the test tube 4 coincides with the vertical line direction 4*y* along the rotation axis 8*a* of the rotor 2.

However, in the bio cell cleaning centrifuge provided with the above conventional bio cell cleaning rotor, it was not enough to suppress unevenness in amount of the cleaning liquid injected in the cleaning liquid injection step and unevenness in amount of the supernatant remaining in the supernatant discharge step.

In order to perform a good blood transfusion test by a centrifuge for automatic bio cell cleaning, it is desirable that: (1) the equal amount of the cleaning liquid is supplied to each of the plural test tubes held by the test tube holders by the cleaning liquid distributor in the cleaning liquid injection step; and (2) the equal amount of supernatant of the cleaning liquid is discharged enough from each of the plural test tubes in the supernatant discharge step.

Namely, in case that there is unevenness in amount of the cleaning liquid supplied in the many test tubes, for example, in case that the supplied amount of the cleaning liquid in one test tube is smaller than the supplied amount of the cleaning liquid in each of the remaining test tubes, bio cell in its one test tube becomes a sample in which greater amount of foreign objects such as antibodies remain in a suspension. To the contrary, in one test tube in which the supplied amount of the cleaning liquid is greater, the amount of the residual foreign objects such as the antibodies in its one test tube is smaller. This difference in residual amount of the foreign objects varies results of a reagent reaction test performed after the cleaning process using the bio cell cleaning centrifuge, so that the difference causes a serious error in judgment of the blood transfusion test.

Further, in case that the cleaning liquid is supplied from the cleaning liquid distributor on the basis of the test tube in which the supplied amount of the cleaning liquid may be small, in a test tube in which the comparatively great amount of the cleaning liquid is injected from the cleaning liquid distributor due to the unevenness in amount of the injected cleaning liquid, the cleaning liquid overflows from its test tube, which causes a problem that a valuable bio cell sample is lost. Further, in case that cleaning frequencies are determined based on the test tube having the small amount of the cleaning liquid, a disadvantage that a long time is required in the cleaning process is caused.

On investigation of the above conventional bio cell cleaning rotor, the present inventor has founded that the unevenness in amount of the cleaning liquid supplied into the respective test tubes occurs by several reasons. One of the reasons is that: since a distance between a cleaning liquid outlet of the conventional cleaning liquid distributor and an opening of the test tube is long, a part of the cleaning liquid injected from the cleaning liquid distributor cannot enter the test tube due to an error in working accuracy of the cleaning liquid outlet hole of the cleaning liquid distributor.

On the other hand, in the supernatant discharging step sequential to the cleaning liquid injection step, in case that the supernatant of the cleaning liquid are discharged from the many test tubes, unevenness in amount of the supernatant discharged from the many test tubes causes also an error in the test result. For example, in a test tube in which the amount of discharged supernatant is smaller, greater amount of the foreign objects such as the antibodies remain in its test tube after the supernatant discharge step. To the contrary, in a test tube in which the amount of discharged supernatant is greater, the amount of the residual foreign objects such as the antibodies in its test tube is smaller. This difference also varies the results of the reagent reaction test subsequently performed by the bio cell cleaning centrifuge, so that the difference causes an error in judgment of the blood transfusion test.

Further, in case that the processing time in the supernatant discharge step is prolonged or the rotation number in the supernatant discharge step is increased on the basis of the test tube in which the amount of the discharged supernatant is small, in the test tube in which the amount of discharged supernatant is greater, even the separated bio cells are discharged out of the test tube, so that a disadvantage that a valuable bio cell sample is lost can occur.

SUMMARY OF THE INVENTION

An object of the present invention is, in view of the problems in the above conventional technology, to provide a bio cell cleaning centrifuge and a bio cell cleaning rotor which can supply the equal amount of cleaning liquid to each of plural test tubes in a cleaning liquid injection step and can discharge the equal amount of supernatant of the cleaning liquid from each of the plural test tubes in a supernatant discharge step.

Another object of the present invention is to provide a bio cell cleaning centrifuge and a bio cell cleaning rotor which can obtain a bio cell test result which is high in reliability by improving a bio cell cleaning advantage.

According to an aspect of the present invention, there is provided a bio cell cleaning centrifuge including: a motor that has a drive shaft; a rotor that is engaged with the drive shaft to be rotated by the motor; a plurality of holders that are equipped on the rotor in a circular array to be rotated together with the rotor and that hold a plurality of test tubes so as to be pivotable toward a rotational radial direction of the rotor; a cleaning liquid distributor that is mounted on the rotor to be rotated together with the rotor and that supplies a cleaning liquid to the plurality of test tubes; a locking mechanism that locks the plurality of holders so that the plurality of test tubes are in a vertical state with respect to the rotational radial direction; and a controller that controls the motor and the locking mechanism, wherein the plurality of holders are configured to hold the plurality of test tubes so that central axes thereof are inclined from a rotational axis direction toward a rotational tangent direction of the rotor.

The controller may perform: (1) an injection process to inject the cleaning liquid into the plurality of test tubes by the cleaning liquid distributor while rotating the rotor; (2) a centrifugal process to deposit floating cells in the plurality of test tubes at bottoms thereof by rotating the rotor; and (3) a supernatant discharge process to discharge a supernatant of the cleaning liquid in the plurality of test tubes by rotating the rotor while locking the plurality of holders in the vertical state by the locking mechanism. The rotor may rotate in a first speed in the centrifugal process. The rotor may rotate in a third speed in the injection process. The first speed may be higher than the third speed.

The rotor may rotate in a second speed in the supernatant discharge process. The second speed may be lower than the first speed.

The rotor may rotate in a first direction in the injection process. The rotor may rotate in a second direction that is opposite to the first direction in the supernatant discharge process.

In the injection process, each holder may hold the test tube to be inclined so that an upper end of the test tube is in a forwarder position in the rotational tangent direction than a lower end thereof.

In the supernatant discharge process, each holder may hold the test tube to be inclined so that an upper end of the test tube is in backwarder position in the rotational tangent direction than a lower end thereof.

According to another aspect of the present invention, there is provided a bio cell cleaning rotor including: a rotor; a plurality of holders that are equipped on the rotor in a circular array to be rotated together with the rotor and that hold a plurality of test tubes so as to be inclined toward a rotational direction of the rotor and so as to be pivotable toward a radial direction of the rotor; and a cleaning liquid distributor that is mounted on the rotor to be rotated together with the rotor and that supplies a cleaning liquid to the plurality of test tubes.

According to the above-mentioned configuration, the plural test tube holders hold the test tubes in the inclined state from the vertical state so that the center axis of each test tube is inclined from the vertical line direction along the rotation axis of the rotor to the horizontal line direction along the tangent of the circle formed by the circular array of the test tube holders. Therefore, in the cleaning liquid injection step, the equal amount of cleaning liquid can be supplied into the many test tubes; and in the supernatant discharge step, the supernatant can be discharged from the many test tubes sufficiently and equally. Hereby, a bio cell cleaning advantage can be improved, so that it is possible to provide a bio cell cleaning centrifuge which can obtain a bio cell test result that is high in reliability.

The above features and other features of the present invention, and the above advantage and other advantage of the present invention will be made still clearer from the following description and accompanying drawings of this specification.

BRIEF DESCRIPTION OF THE DRAWINGS

Embodiments of the present invention will be described in detail based on the following figures, wherein.

DETAILED DESCRIPTION OF THE INVENTION

Figure 1:
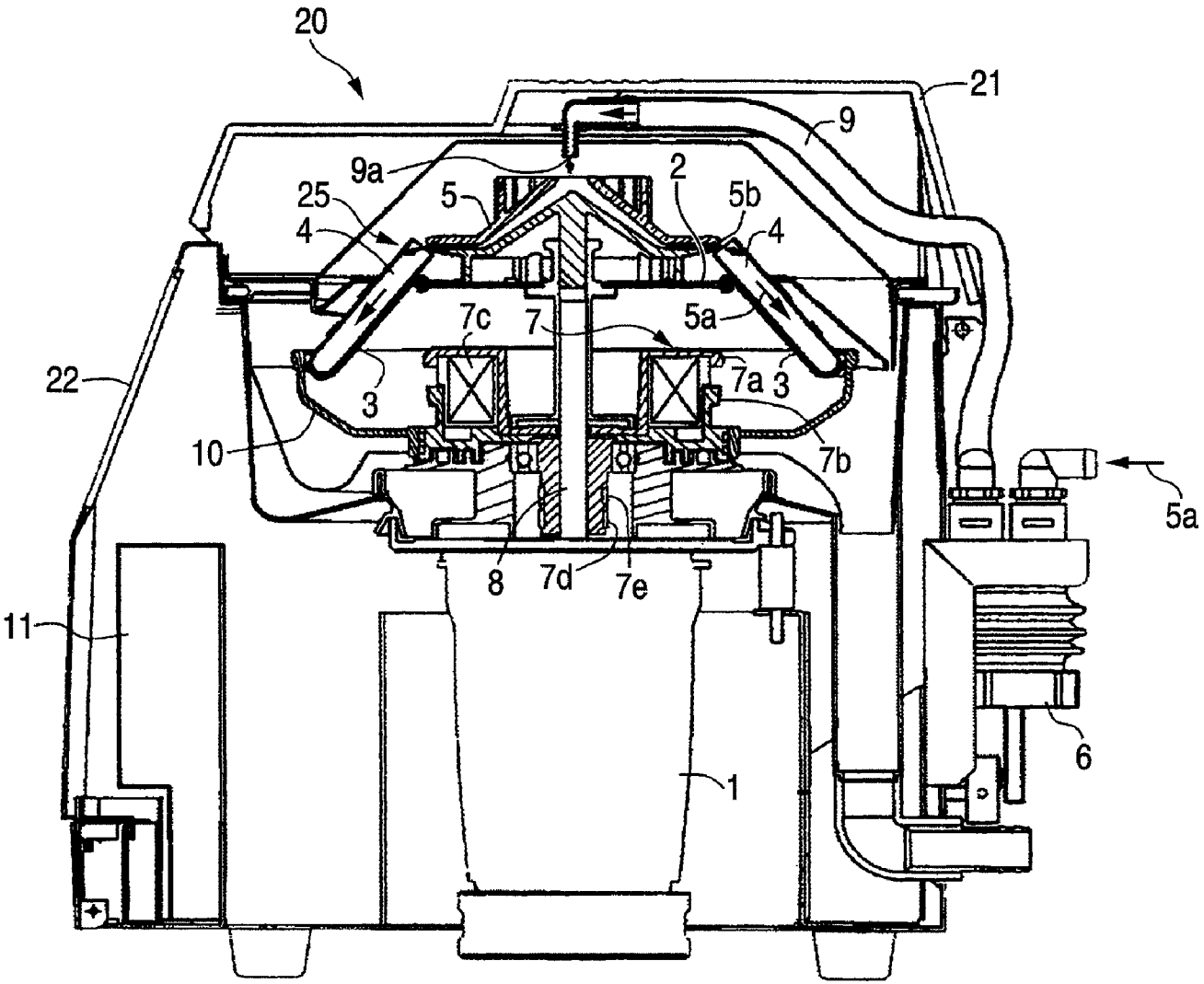
FIG. 1 is a sectional view showing the entirety of a bio cell cleaning centrifuge according to the embodiment.

An embodiment of the present invention will be described below in detail with reference to drawings. In all the figures for explaining the embodiment, members having the same function are denoted by the same reference numerals and the repeated description of them is omitted. Further, members having the same or similar structure or function as or to those in the conventional technology are denoted by the same reference numerals as those in the conventional technology.

Figure 2:
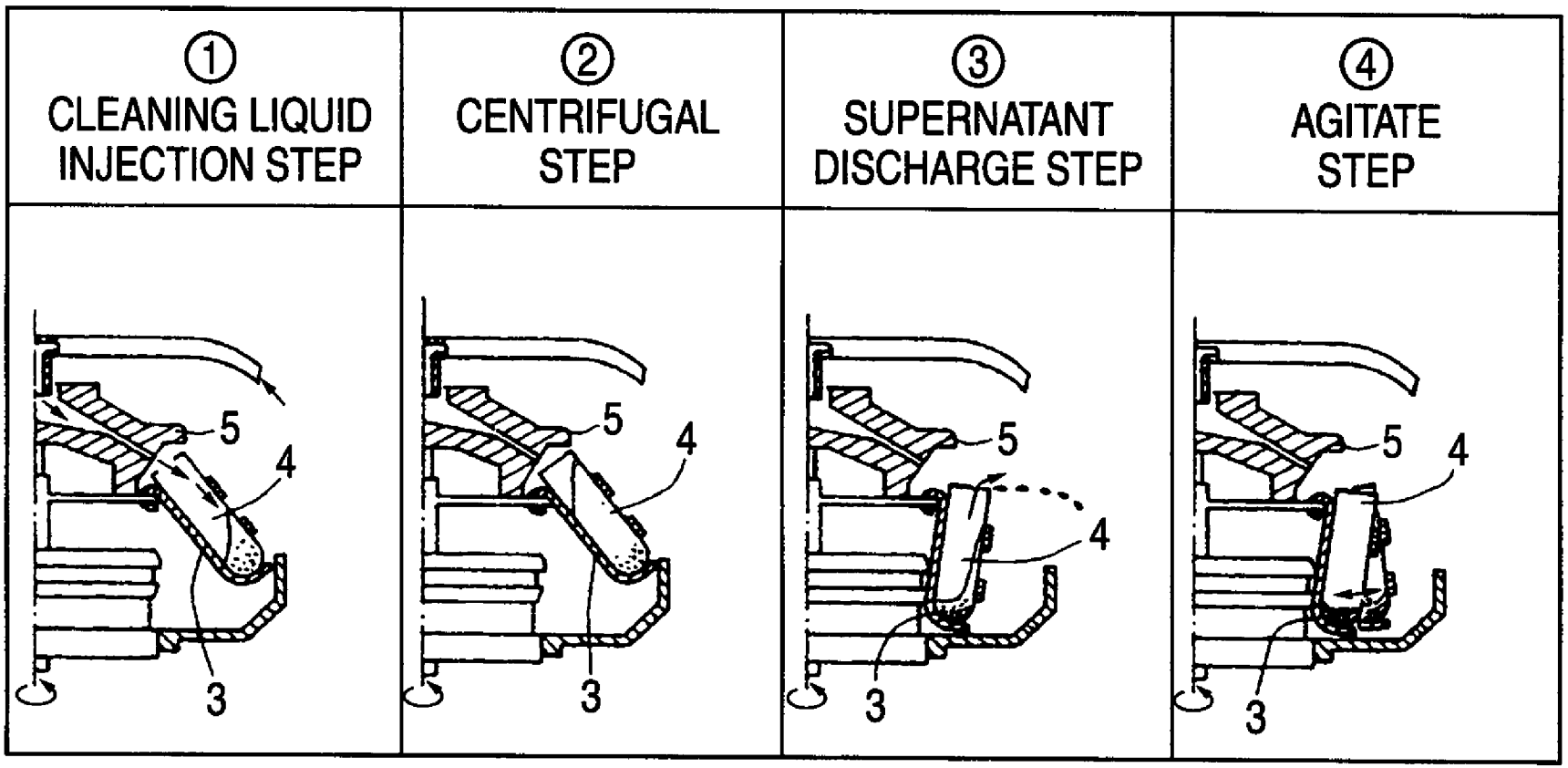
FIG. 2 is a main portion sectional view of a centrifugal separator in each step of a blood cell cleaning process executed by the bio cell cleaning centrifuge shown in FIG. 1.
Figure 3:
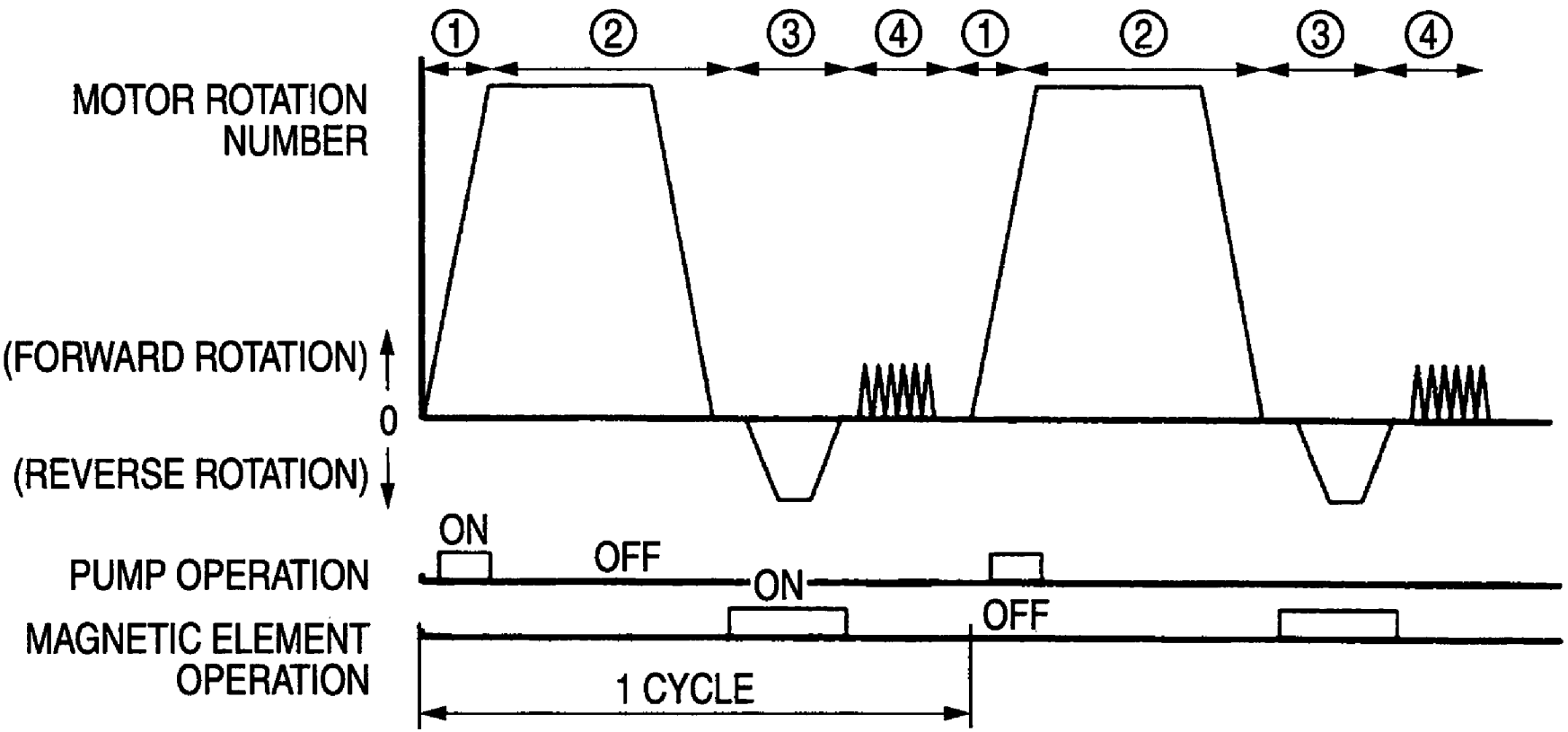
FIG. 3 is a time chart for controlling rotation speed of a motor, a pump operation and a magnetic element operation in the bio cell cleaning centrifuge shown in FIG. 1.

FIG. 1 is a sectional view showing the entire constitution of a bio cell cleaning centrifuge according to the embodiment, FIG. 2 is a sectional view showing an operating state of a test tube holder of the bio cell cleaning centrifuge in each step of a cleaning process, and FIG. 3 is a time chart showing rotation speed of a motor in the bio cell cleaning centrifuge according to the embodiment, a pump operation and timing of energization to a magnetic element.

As shown in FIG. 1, a bio cell cleaning centrifuge 20 according to the embodiment includes a housing (frame) 22 having a quadrilateral section viewed from a top surface, and a door 21 for opening or closing the upper part of the housing 22. In this housing 22, there are assembled a motor 1 having a drive shaft (rotation axis) 8, and a rotor 2 which is coupled to the drive shaft 8 of the motor 1 and rotated by the motor 1.

Figure 4:
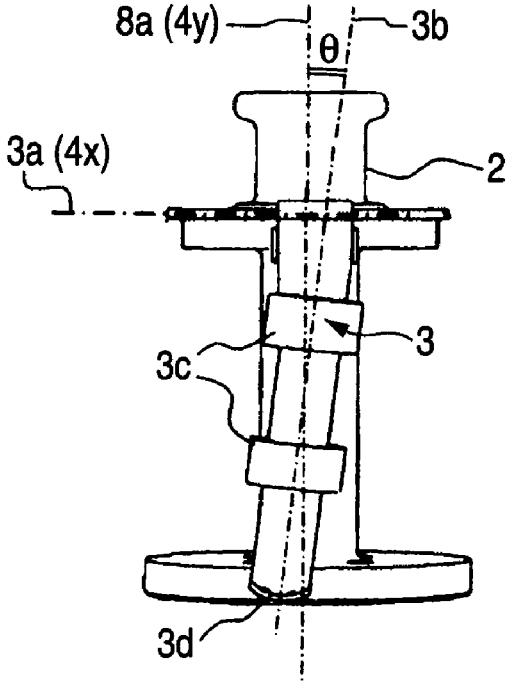
FIG. 4 is a front view showing a relation between a pivot axis of a test tube holder which constitutes the bio cell cleaning centrifuge shown in FIG. 1 and a rotation axis of a rotor.

On the rotor 2, plural (for example, 24 pieces) test tube holders 3 are disposed in a circular array viewed from an upper surface so as to be pivotally movable. The test tube holder 3 is formed by a magnetic member, and includes, as shown in FIG. 4, a hold insertion part 3*c* into which a test tube 4 is inserted, and a hold bottom part 3*d* for supporting the bottom of the test tube 4. In each test tube holder 3, there is held the test tube 4 into which a proper amount of bio cell such as red blood cell is previously supplied.

Further, the bio cell cleaning centrifuge 20 includes a locking mechanism 7 for locking the test tube holder 3 on the rotor 2 vertically or at a small angle that is nearly vertical, seen from a direction traversing the sectional view of FIG. 1, that is, seen from a tangent direction of a circle formed by the circular array of the test tube holders 3. In this embodiment, the locking mechanism 7 is composed of a magnetic element for attracting and locking the test tube holder 3 by magnetic force. The locking mechanism 7 includes a disc-shaped upper magnetic member 7*a*, a lower magnetic member 7*b*, and further a ring-shaped coil (magnetic coil) 7*c* that is an insulated electrical conductor installed so as to be put between these upper magnetic member 7*a* and lower magnetic member 7*b*. These magnetic members 7*a*, 7*b* and magnetic coil 7*c* are fixed to the drive shaft 8 of the motor 1, and rotate integrally with the rotor 2. A control device 11 supplies electric current through a pair of slip rings 7*d* and 7*e* to the rotating magnetic coil 7*c*, thereby to control magnetic forces generated in the upper magnetic member 7*a* and the lower magnetic member 7*b*. When the electric power is supplied to the magnetic coil 7*c* by the control device 11, a magnetic field is produced, and the test tube holder 3 described later that is formed of magnetic material, for example, SUS430 forms a magnetic circuit together with the upper magnetic member 7*a* and the lower magnetic member 7*b*. Therefore, the test tube holder 3 is strongly attracted to the upper magnetic member 7*a* and the lower magnetic member 7*b* (magnetic element 7). Namely, by applying the electric current to the magnetic coil 7*c*, the locking mechanism 7 (magnetic members 7*a* and 7*b*) acts as a magnet, and attracts the test tube holder 3 formed of the magnetic member. In this embodiment, the outer diameter of the upper magnetic member 7*a* is larger than that of the lower magnetic member 7*b*. Hereby, the attraction surfaces of the magnetic members 7*a* and 7*b* (magnetic element 7) can attract the test tube holder 3 in such a way that the test tube 4 is opened at an angle of about 8 degrees in the outer circumferential direction of the circular array of the test tube holders 3 in relation to a vertical line (mono-direction which is parallel to the rotor rotation axis).

Figure 5:
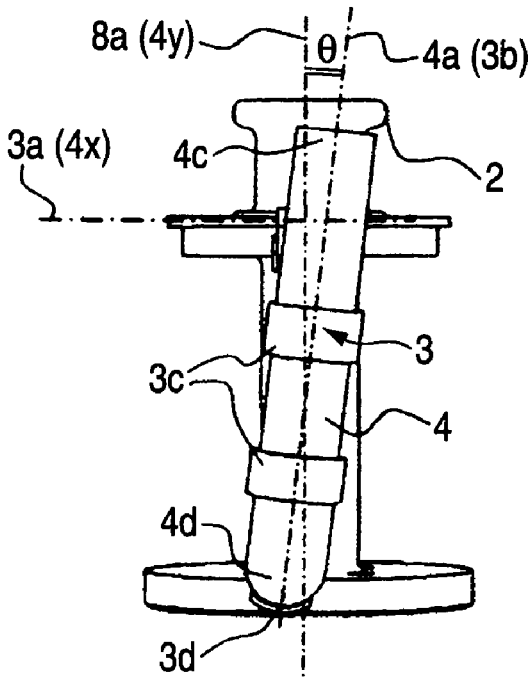
FIG. 5 is a front view showing a relation between the pivot axis of the test tube holder which constitutes the bio cell cleaning centrifuge shown in FIG. 1 and a center axis of a test tube.
Figure 10:
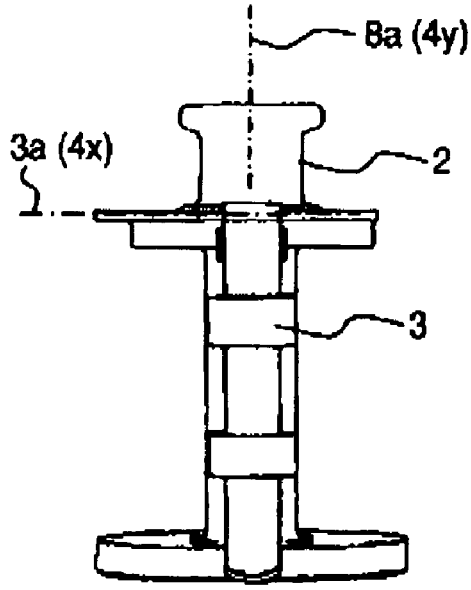
FIG. 10 PRIOR ART
FIG. 10 is a front view showing a relation between a pivot axis of a test tube holder which constitutes the bio cell cleaning centrifuge according to the conventional technology and a rotation axis of a rotor.
Figure 11:
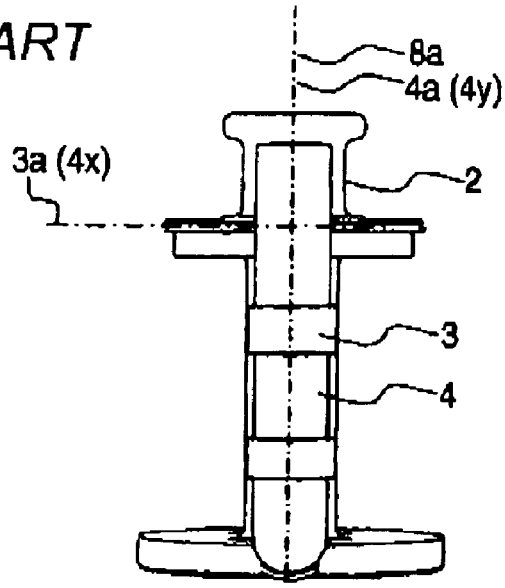
FIG. 11 PRIOR ART
FIG. 11 is a front view showing a relation between the pivot axis of the test tube holder which constitutes the bio cell cleaning centrifuge according to the conventional technology and a center axis of a test tube.

In the embodiment, the test tube holder 3, as shown in FIGS. 4 and 5, when holding the test tube 4, holds the test tube 4 in an inclined state from a vertical state 4*y* in such a way that a center axis 4*a* (refer to FIG. 5) of the test tube 4 is inclined at a predetermined angle θ from a vertical line direction 4*y* (which coincides with the rotation axis 8*a* in the front views of FIGS. 4 and 5) along the rotation axis 8*a* of the rotor 2, to a horizontal line direction 4*x* (which coincides with a direction 3*a* in FIGS. 4 and 5) along a tangent of the circle formed by the circular array of the many test tube holders 4. Namely, as shown in FIG. 4, a pivot axis 3*a* (which coincides with the tangent direction 4*x* of the circular array) of the test tube holder 3 attached onto the rotor 2 and the rotation axis 8*a* (vertical line direction 4*y*) of the rotor 2 are at right angles to each other, and a center axis 3*b* of the hold insert part 3*c* and the hold bottom part 3*d* into which the test tube 4 is inserted is inclined at only the angle θ in relation to the pivot axis 3*a* (horizontal line direction 4*x*). Namely, as shown in FIG. 5, the positional relation between the center axis 4*a* of the test tube 4 and the rotation axis 8*a* (vertical line 4*y*) of the rotor 2 is a torsion relation, which is different from the conventional positional relation shown in FIGS. 10 and 11 in which the center axis 4*a* and the rotation axis 8*a* are on the same plane. The above inclined angle θ is set to, for example, 10 degrees. This inclined angle θ can be selected within a range of 5 to 30 degrees in accordance with rotation speed of the rotor 2. Desirably, the inclined angle θ is set to 10 to 15 degrees.

Figure 6:
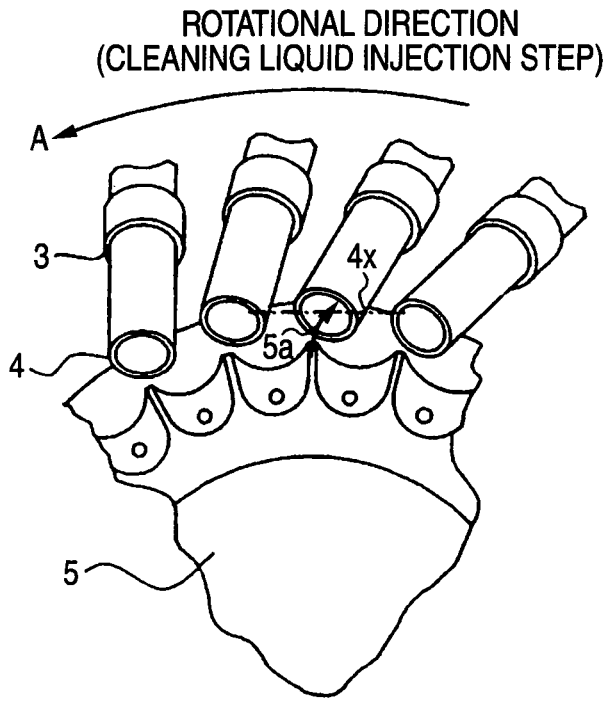
FIG. 6 is a plan view showing a relation between a cleaning liquid distributor and the test tube in a cleaning liquid injection step according to the embodiment.

Further, in the embodiment, as shown in FIGS. 5 and 6, the inclination of the center axis 4*a* of the above test tube 4 (test tube holder 3) has the inclined angle θ so that an upper part 4*c* of the test tube 4 is located in a forwarder position in a rotational direction A of the rotor 2 in a cleaning liquid injection step described later than a lower part 4*d* thereof.

Figure 7:
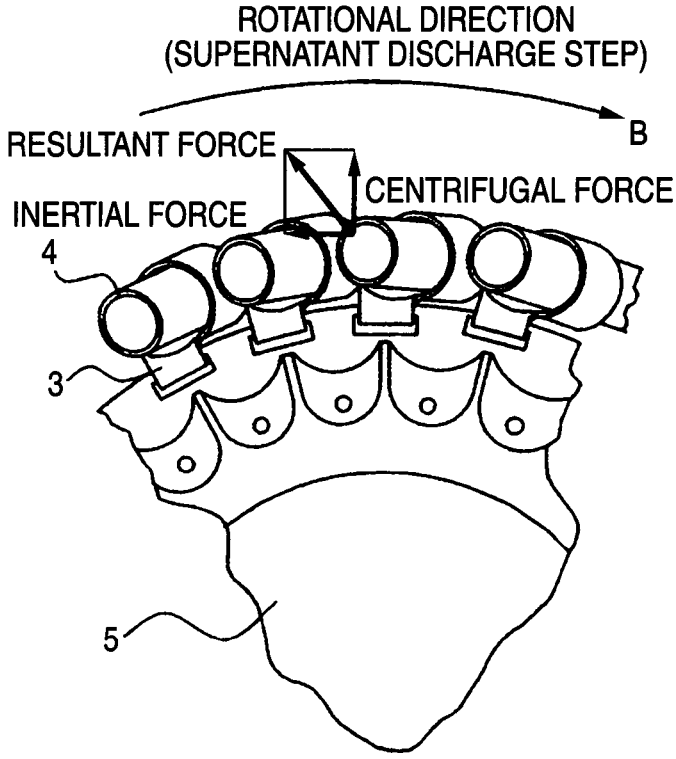
FIG. 7 is a plan view showing a relation between the cleaning liquid distributor and the test tube in a supernatant discharge step according to the embodiment.
Figure 8:
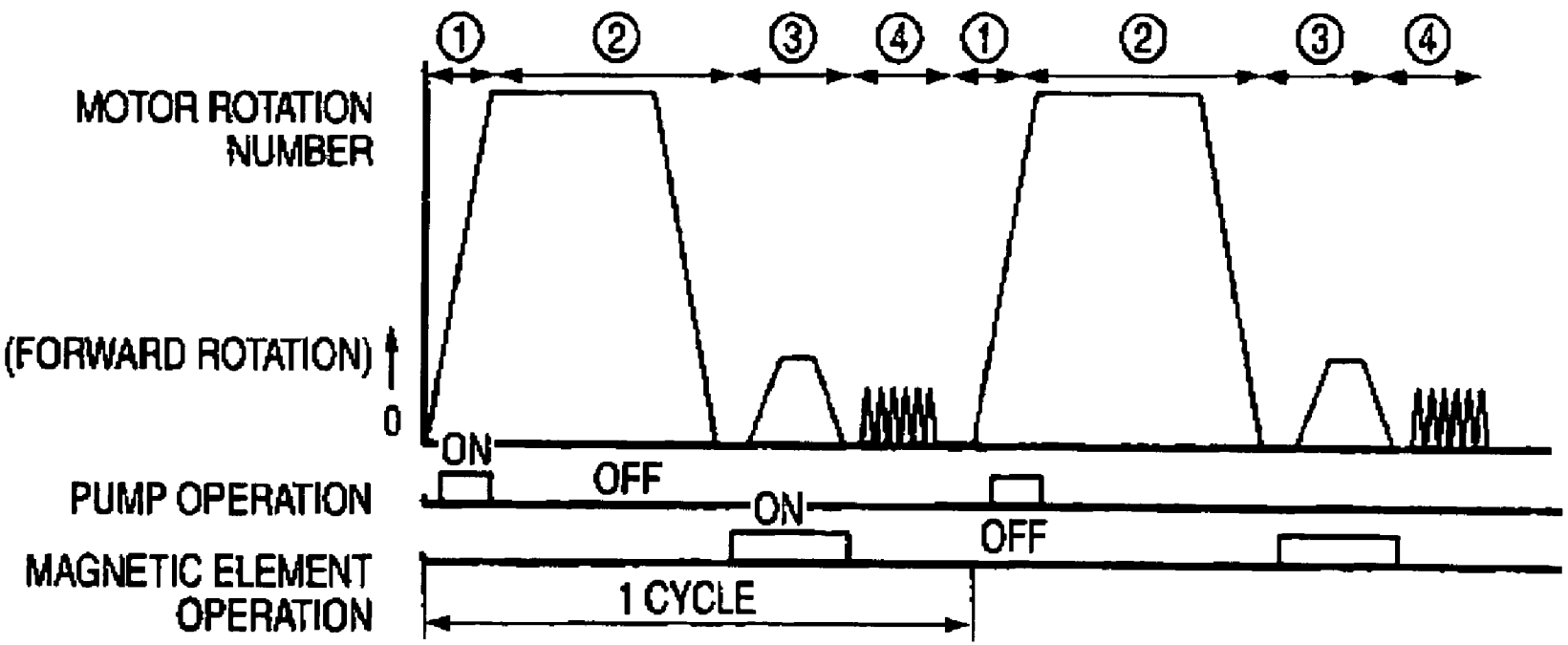
FIG. 8 PRIOR ART
FIG. 8 is a time chart for controlling rotation speed of a motor, a pump operation and a magnetic element operation in a bio cell cleaning centrifuge according to a conventional technology.

Further, in the embodiment, as shown in FIG. 7, a rotational direction B of the rotor 2 in a supernatant discharge step described later is controlled to a direction reverse to the rotational direction A of the rotor in the cleaning liquid injection step. Accordingly, a center axis 3*b* of the above test tube holder 3, that is, the center axis 4*a* of the test tube 4 is inclined so that the upper part 4*c* of the test tube 4 is located in a more backward position in the rotational direction B of the rotor 2 in the supernatant discharge step than the lower part 4*d* thereof.

The test tube holder 3, in a centrifugal step described later in the cleaning process, in a state where the operation of the magnetic element 7 is made off by the control device 11 and the attraction force is released, receives the centrifugal force which acts according to the high rotation number of the rotor 2 and pivotally moves in the horizontal direction. Hereby, the test tube holder 3 which holds the test tube 4 moves pivotally in a radially horizontal direction of the circumference of the rotor, slants till the lower part of the test tube holder 3 contacts against a bowl 10, and separates centrifugally a sample such as blood cell in the test tube 4. For example, in the state where the operation of the magnetic element 7 is made off and the attraction force is released, at the rotation number of the motor 1 of 3000 rpm, when the lower part of the test tube holder 3 contacts against the bowl 10, the test tube holder 3 moves pivotally so that an angle formed by the test tube 4 and the vertical line becomes about 40 degrees. The motor 1 is composed of, for example, an induction motor, and the rotation number (rotation speed) can be controlled by the control device 11.

Figure 9:
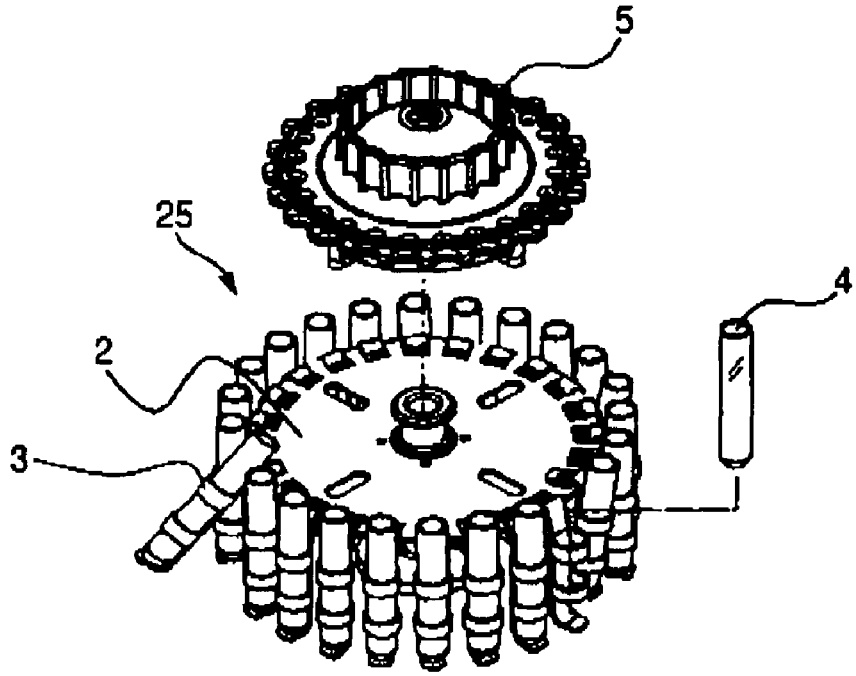
FIG. 9 PRIOR ART
FIG. 9 is a perspective view showing the structure of a bio cell cleaning rotor in a bio cell cleaning centrifuge according to the conventional technology, which includes a cleaning liquid distributor and a rotor.

Further, the bio cell cleaning centrifuge 20 includes a cleaning liquid distributor 5 which supplies cleaning liquid 5*a* into the plural test tubes 4 disposed in the circular array. The cleaning liquid distributor 5 has the same structure as that in the conventional technology which is shown in FIG. 9 and has been disclosed in JP-2003-337088-A. The cleaning liquid distributor 5 is formed on the rotor 2 so as to rotate integrally with the rotor 2 equipped with the test tube holders 3 disposed in the circular array, and constitutes a so-called bio cell cleaning rotor 25 integrally with the rotor 2.

Associated with the cleaning liquid distributor 5, a cleaning liquid supply path 9 is provided, to which a pump 6 is coupled. By switching on (ON) a power supply for operation of the pump 6 by the control device 11, the cleaning liquid 5*a* can be supplied from an external cleaning liquid tank (not shown) through the cleaning liquid supply path 9 to a nozzle 9*a* located at the upper part of the bio cell cleaning centrifuge 20. In the cleaning liquid injection step described later, the cleaning liquid injected downward from the nozzle 9*a* enters a center part of the cleaning liquid distributor 5 rotating at a high speed integrally with the rotor 2, is distributed to the outer circumference of the cleaning liquid distributor 5 by centrifugal force, supplied to each of flowing paths having the same number (24) as the number of test tubes 4 held by the test tube holders 3, and injected from peripheral injection inlet 5*b* of the distributor 5 into the respective test tubes 4 with vigor.

Next, a case where a blood cell cleaning process for performing a blood transfusion test is executed by the bio cell cleaning centrifuge 20 will be described below with reference to a main portion sectional view of the centrifuge in each step of the cleaning process shown in FIG. 2, and an operation time chart of the centrifuge shown in FIG. 3.

First, in the cleaning liquid injection step, as shown in the time chart (1) of FIG. 3 and the step sectional view (1) of FIG. 2, the motor 1 (rotor 2) is rotated in an accelerative manner till its maximum rotation number (maximum rotation speed) comes to 3000 rpm, whereby the centrifugal force is applied to the twenty-four test tube holders 3 which hold the twenty-four test tubes 4 in each of which a proper amount of bio cell such blood cell has been put. Since the cleaning liquid (for example, physiological saline) 5*a* obtains motion energy by this centrifugal force as described above, the pump 6 is actuated midway of acceleration when the rotation number of the motor 1 comes to about 1000 rpm, thereby to inject the cleaning liquid 5*a* into the cleaning liquid distributor 5. The cleaning liquid 5*a* is distributed to the outer circumference of the cleaning liquid distributor 5 by the centrifugal force, supplied to each of the flowing paths having the same number (24) as the number of test tubes 4 held by the test tube holders 3, and flows out from the outer circumference of the distributor 5 with vigor. The cleaning liquid 5*a* injected from the distributor 5 into the test tube 4 impinges on an inner wall of each test tube 4 located outside the cleaning liquid distributor 5, and moves along the wall surface of the test tube 4 toward a bottom of the test tube 4. This motion permits the bio cell existing at the bottom of the test tube 4 to be floated thereby to form a suspension state. After the predetermined amount of the cleaning liquid 5*a* has been injected into the test tube 4, the operation of the pump 6 is stopped by the control device 11 to terminate the cleaning liquid injection step.

In the cleaning liquid injection step (1), according to the attachment structure of the test tube holder 3 in the embodiment, it is possible to suppress unevenness in amount of the cleaning liquid 5*a* injected into the many test tubes 4.

Namely, in the cleaning liquid injection step (1) the relation between the cleaning distributor 5 and the test tube 4 is as shown in a plan view (perspective view) of FIG. 6, in which the cleaning liquid 5*a* flowing out of the cleaning liquid distributor 5, upon reception of the wind pressure produced by rotation of the rotor 2, and force in the direction reverse to the rotational direction by Coriolis force, flies in the air while curving in the direction reverse to the rotational direction A, and is injected into each test tube 4 located outside the cleaning liquid distributor 5 with vigor. The cleaning liquid 5*a*, when the rotation number of the rotor 2 (motor 1) is 1000 rpm, is injected into the cleaning liquid distributor 5 and flows out of the periphery of the distributor 5. Near each test tube 4 which is about 10 mm distant from the peripheral injection inlet 5*b*, a flying locus of the cleaning liquid 5*a* curves at about 5 degrees. Further, when the rotation number of the rotor 2 (motor 1) is 3000 rpm, the flying locus curves more, and it curves at about 30 degree near each test tube 4.

At this time, as described above, the center axis 4*a* of the test tube 4 forms such the positional relation of torsion that the upper part 4*c* of the test tube 4 is in the forwarder position in relation to the horizontal line direction 4*x* (pivotal axis 3*a* direction) along the tangent of the circular array than the lower part 4*d* thereof, and the test tube 4 is attached so that the inclined angle θ thereof becomes an angle of 5 to 30 degrees which is similar to the angle of the curved flying locus of the flowing-out cleaning liquid 5*a*. Therefore, a reception part (opening part) of the test tube upper part 4*c* faces right to the injection direction of the cleaning liquid 5*a*, and it is possible to expand more greatly the reception area for the cleaning liquid 5*a* supplied from the cleaning liquid distributor 5 upon reception of influence of the wind pressure than the reception area in the processing step in the conventional technology shown in FIG. 12. The inclined angle θ is more desirably set to 10 to 15 degrees which approximates to an average of the angles of the curved flying locus of the cleaning liquid 5*a*, whereby the injection advantage of the cleaning liquid 5*a* can be made largest.

In this result, the cleaning liquid 5*a*, when injected into the test tube 4, impinges on the inner wall of the test tube 4, whereby the cleaning liquid 5*a*, without reducing the motion energy thereof, permits the bio cells existing at the bottom (lower) part 4*d* of the test tube 4 to be floated to form the enough suspension state. Further, since the reception part of the test tube 4 faces right to the injection direction of the cleaning liquid 5*a*, the largest dependability (injection amount) when the cleaning liquid 5*a* is injected into the test tube 4 is provided, so that the unevenness in amount of the cleaning liquid 5*a* injected to the respective test tubes 4 can be reduced.

After a proper amount of the cleaning liquid 5*a* has been supplied into the test tube 4 in the above step, the operation of the pump 6 is stopped by the control device 11 to terminate the cleaning liquid injection step (1). Subsequently, in the centrifugal step (2), as shown in the time chart (2) of FIG. 3 and the sectional view (2) of FIG. 2, high-speed rotation, for example, rotation at 3000 rpm in this embodiment is continued for 35 sec. under such a high-speed rotation condition that the floating bio cells are deposited at the bottom part 4*d* of the test tube 4 and unwanted substance such as blood serum remains in a supernatant, thereby to perform centrifugal separation. After the centrifugal separation, the rotation of the motor 1 is stopped.

Next, in the supernatant discharge step (3), as shown in the time chart (3) of FIG. 3 and the sectional view (3) of FIG. 2, the ring-shaped coil 7*c* is energized by the control device 11 to put the operation of the magnetic element 7 in an ON-state. Hereby, the magnetic element 7 attracts and holds the test tube holder 3 formed of the magnetic material. Since the outer diameter of the upper magnetic member 7*a* of the magnetic element 7 is a little larger than that of the lower magnetic member 7*b* as described above, the surface of the test tube holder 3 attracted to the magnetic element 7 is held in a state close to a substantially vertical state where the surface is opened upward in the radial direction at an angle of about 8 degrees, and the test tube holder 3 rotates.

As shown in FIG. 7, a rotational direction B of the rotor in the supernatant discharge step (3) is reverse to the rotational direction A of the rotor in the preceding cleaning liquid injection step, and the rotation number is increased to about 400 rpm. Then, the supernatant in the test tube 4 receives a force in a direction of a resultant force of the centrifugal force generated by the rotation of 400 rpm and an inertial force, thereby to rise on the inner wall surface of the test tube 4. It should be noted that the rotational direction B in this step is a different from a rotational direction A in the conventional technology shown in FIG. 13.

According to the supernatant discharge step (3) of the embodiment, as shown in FIG. 7, since the center axis 4*a* of the test tube 4 forms such the positional relation of torsion with the rotation axis vertical direction 4*y* (or rotor rotation axis 8*a*) that the upper part 4*c* of the test tube 4 is in a more backward position than the lower part 4*d* thereof, the opening part 4*c* of the test tube 4 is inclined in the direction of resultant force of the centrifugal force and the inertial force. In result, the supernatant can reach the opening part 4*c* through the shortest path on the wall surface of the test tube 4. Therefore, the supernatant is discharged to the outside in the shortest time, only the bio cell such as red blood cell existing at the bottom part 4*d* of the test tube 4 can be left at the bottom part as it is, the amount of the residual supernatant in each test tube 4 can be reduced, and the processing time in the supernatant discharge step (3) can be reduced more remarkably than that in the conventional technology shown in FIG. 13.

After the supernatant discharge step, in an agitate step (4), as shown in the time chart (4) of FIG. 3 and the sectional view (4) of FIG. 2, the rotation and stop of the rotor 1 are gradually repeated by turns. Hereby, the test tube holder 3 is swung in the outer circumferential direction due to the centrifugal force generated by the rotation, and hits against the magnetic element 7 with the stop of the motor, whereby agitation is given to the tube holder 3, and there is produced an advantage of softening a clot of the cell deposited and solidified at the bottom of the test tube 4.

The above-described cleaning step (1) to the agitate step (4) form one cleaning cycle. By repeating this cleaning cycle three to four times, the bio cell such as the red blood cell in the test tube 4 can be cleaned, and foreign objects such as antibodies can be more completely separated and removed.

Figure 12:
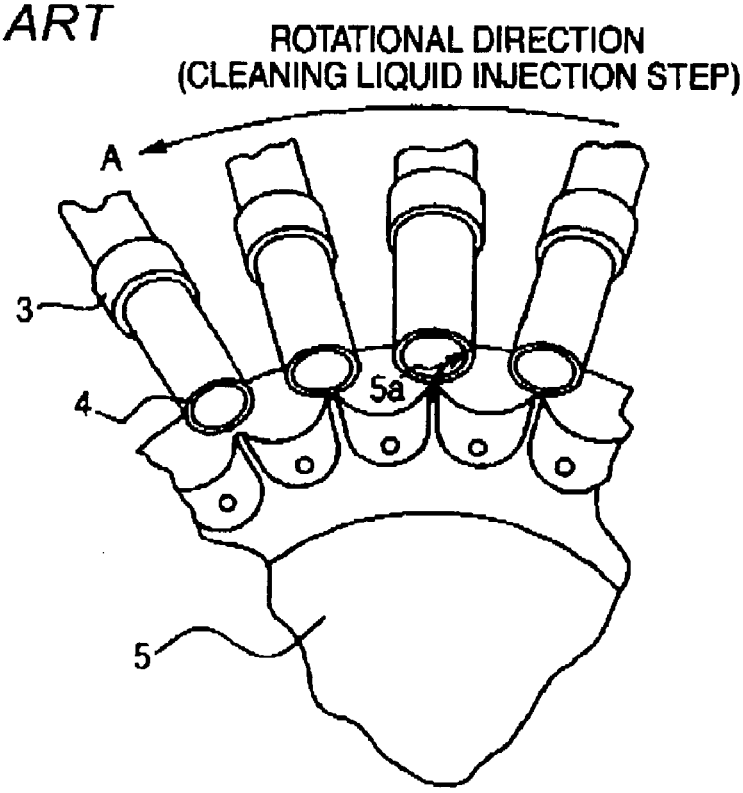
FIG. 12 PRIOR ART
FIG. 12 is a plan view showing a relation between a cleaning liquid distributor and a test tube in a cleaning liquid injection step according to the conventional technology.

As clear from the above description, according to the embodiment, as shown in FIGS. 6 and 12, in the cleaning liquid injection step of the cleaning cycle, the unevenness in amount of the injected cleaning liquid can be reduced, compared with the conventional case. Further, since the motion energy of the injected cleaning liquid can be also increased, the bio cells existing at the bottom of the test tube 4 can be floated to form the enough suspension state.

Figure 13:
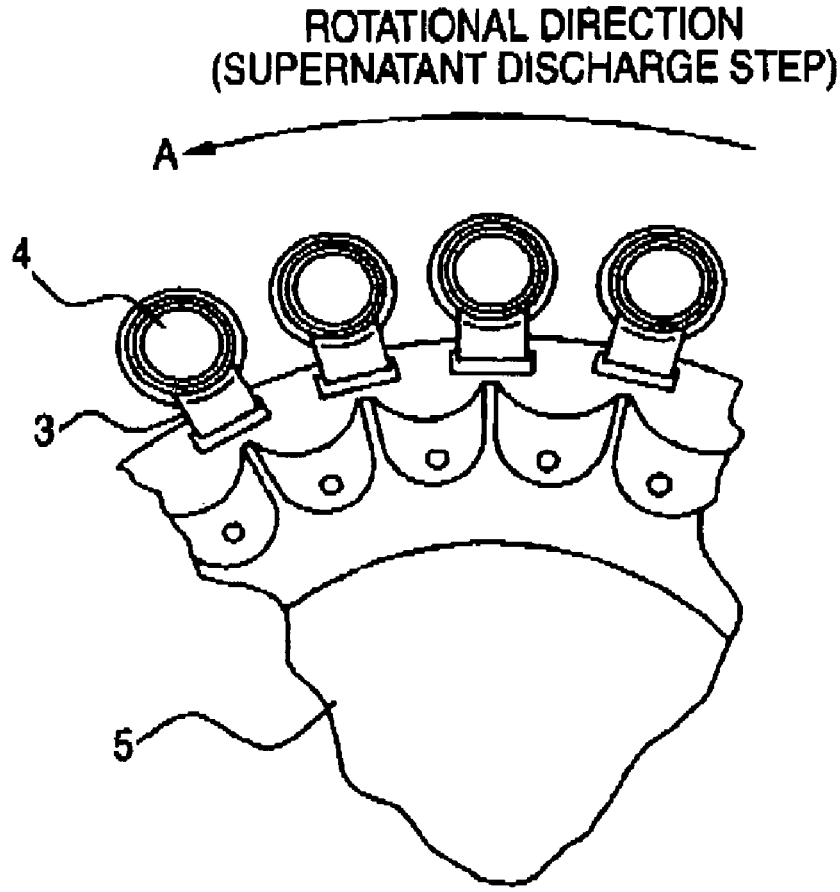
FIG. 13 PRIOR ART
FIG. 13 is a plan view showing a relation between the cleaning liquid distributor and the test tube in a supernatant discharge step according to the conventional technology.

Further, according to the embodiment, as shown in FIGS. 7 and 13, in the supernatant discharge step, the greater amount of supernatant can be discharged out of the test tube in a shorter time than in the conventional case, so that the unevenness in amount of the supernatants remaining in the many test tubes 4 can be reduced.

Since the cleaning advantage becomes equal according to the above constitution, it is possible to a bio cell cleaning centrifuge which is good in cleaning characteristic and high in reliability. Further, since reduction in the use amount of the cleaning liquid and reduction in the number of cleaning cycles can be performed, it is possible to a bio cell cleaning centrifuge in which resource saving, energy saving, and reduction of the test time are also possible.

In the above embodiment, the inclined angle θ of the center axis 3*b* of the test tube holder 3 is formed by slanting partially the holding parts 3*c*, 3*d* of the test tube 4. However, without slanting partially the holding part 3*c*, by slanting each pivot axis 3*a* of the many test tube holders 3 in relation to the horizontal axis, the test tube holders 3 may be attached to the rotor 2 so as to be pivotally movable in a state where the center axes of all the test tube holders 3 are inclined.

Although the present invention made by the inventor has been described with reference to the embodiment, the present invention is not limited to the above embodiment but various changes and modifications may be made without departing the spirit and scope of the present invention.

What is claimed is:

1. A bio cell cleaning centrifuge comprising:

a motor that has a drive shaft;

a rotor that is engaged with the drive shaft to be rotated by the motor;

a plurality of holders that are equipped on the rotor in a circular array to be rotated together with the rotor and that hold a plurality of test tubes so as to be pivotable toward a rotational radial direction of the rotor, central axes of the holders being inclined toward a rotational tangent direction of the rotor;

a cleaning liquid distributor that is mounted on the rotor to be rotated together with the rotor and that supplies a cleaning liquid to the plurality of test tubes; and a controller configured to control the motor to rotate in a first direction in an injection process in which a cleaning liquid is injected into the plurality of test tubes and to rotate in a second direction that is opposite to the first direction in a supernatant discharge process in which the cleaning liquid is discharged by rotating the rotor while locking the plurality of holders in the vertical state by a locking mechanism.

2. The bio cell cleaning centrifuge according to claim 1, wherein the controller is configured to control the rotor such that the rotor rotates at a second speed in a centrifugal process in which floating cells in the plurality of test tubes are deposited at bottoms by rotating the rotor, and rotates at a first speed in the injection process, wherein the second speed is higher than the first speed.

3. The bio cell cleaning centrifuge according to claim 2, wherein the controller is configured to control the rotor such that the rotor rotates at a third speed in the supernatant discharge process, and wherein the second speed is higher than the third speed.

4. The bio cell cleaning centrifuge according to claim 1, wherein, each holder is configured to be inclined so that an upper end of the test tube is in a forwarder position in the rotational tangent direction than a lower end thereof in the injection process, and the upper end of the test tube is in a backwarder position in the rotational tangent direction than the lower end thereof in the supernatant discharge process.

5. A method of controlling a bio cell cleaning centrifuge, said bio cell cleaning centrifuge comprising:

a motor that has a drive shaft;

a rotor that is engaged with the drive shaft to be rotated by the motor;

plurality of holders that are equipped on the rotor in a circular array to be rotated together with the rotor and that hold a plurality of test tubes so as to be pivotable toward a rotational radial direction of the rotor, central axes of the holders being inclined toward a rotational tangent direction of the rotor;

a cleaning liquid distributor that is mounted on the rotor to be rotated together with the rotor and that supplies a cleaning liquid to the plurality of test tubes; and a controller configured to control the motor to rotate in a first direction in an injection process in which a cleaning liquid is injected into the plurality of test tubes and to rotate in a second direction that is opposite to the first direction in a supernatant discharge process in which the cleaning liquid is discharged by rotating the rotor while locking the plurality of holders in the vertical state by a locking mechanism:

the method comprises steps of:

injecting the cleaning liquid into the plurality of test tubes while rotating the rotor in a first rotational direction at a first speed and holding the test tubes in an inclined state such that an upper end of the test tube is in a forwarder position in a rotational tangent direction than a lower end thereof;

depositing floating cells in the plurality of test tubes at bottoms thereof while rotating the rotor at a second speed; and discharging a supernatant of the cleaning liquid in the plurality of test tubes while rotating the rotor in a second rotational direction that is opposite to the first rotational direction at a third speed and holding the test tubes in an inclined state such that an upper end of the test tube is in a backwarder position in the rotational tangent direction than a lower end thereof.

6. The method according to claim 5, wherein the second speed is higher than the first speed.

7. The method according to claim 5, wherein the second speed is higher than the third speed.

* * * * *